US008162449B2

(12) United States Patent
Okazawa

(10) Patent No.: US 8,162,449 B2
(45) Date of Patent: Apr. 24, 2012

(54) LIQUID EJECTING HEAD AND LIQUID EJECTING APPARATUS

(75) Inventor: Noriaki Okazawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 356 days.

(21) Appl. No.: 12/620,658

(22) Filed: Nov. 18, 2009

(65) Prior Publication Data

US 2010/0123757 A1 May 20, 2010

(30) Foreign Application Priority Data

Nov. 19, 2008 (JP) ..... 2008-295867
Aug. 19, 2009 (JP) ..... 2009-190144

(51) Int. Cl.
*B41J 2/045* (2006.01)

(52) U.S. Cl. ..... 347/70

(58) Field of Classification Search ..... 347/70
See application file for complete search history.

(56) References Cited

U.S. PATENT DOCUMENTS 5,446,485 A * 8/1995 Usui et al. ..... 347/72

FOREIGN PATENT DOCUMENTS

JP 2000-211125 8/2000

* cited by examiner

*Primary Examiner* — Jerry Rahll
(74) *Attorney, Agent, or Firm* — Workman Nydegger

(57) ABSTRACT

A liquid ejecting head includes pressure generation elements that apply pressure change to liquid retained in corresponding pressure generation chambers to discharge the liquid from corresponding nozzle openings. Each of the pressure generation elements is fixed to a fixation plate. Nozzle lines include nozzle openings arrayed in a line. An electrical signal is sent through a flexible substrate from the outside to the pressure generation chambers. Pressure generation elements associated with the pressure generation chambers are fixed to the fixation plate, with the fixation plate being positioned between the pressure generation elements of each of two parallel nozzle lines. A wiring portion is formed at one end part of the fixation plate opposite to the other end that is closer to the pressure generation chambers. The flexible substrate is connected to the wiring portion.

7 Claims, 7 Drawing Sheets

LIQUID EJECTING HEAD AND LIQUID EJECTING APPARATUS

BACKGROUND

1. Technical Field

The present invention relates to a liquid ejecting head such as an ink-jet recording head that ejects, utilizing a pressure change, liquid drops from nozzle openings. In addition, the invention relates to a liquid ejecting apparatus that is provided with such a liquid ejecting head.

2. Related Art

A liquid ejecting apparatus is provided with a liquid ejecting head that can eject liquid. Having such a liquid ejecting head, a liquid ejecting apparatus is capable of ejecting various kinds of liquid. An example of a liquid ejecting apparatus is an image recording apparatus such as an ink-jet printer. An ink-jet printer is provided with an ink-jet recording head, which is an example of various kinds of a liquid ejecting head. An ink-jet printer performs recording by ejecting ink in the form of ink drops from nozzles of the ink-jet recording head toward a recording target medium such as a sheet of printing paper or the like. As a result of the landing of the discharged ink drops onto the surface of the liquid-ejecting target object, dots are formed thereon. In this way, the ink-jet printer records an image and the like on the recording target medium. The ink-jet recording head may be hereinafter simply referred to as a "recording head". These days, the application of such a liquid ejecting apparatus is not limited to an image recording apparatus mentioned above; for example, a liquid ejecting apparatus is used as, among many other types of manufacturing apparatuses, a manufacturing apparatus used for production of a color filter for a liquid crystal display device.

The following is an example of the structure of the recording head. An elastic plate seals pressure generation chambers, which are hollow compartments. The frond ends of pressure generation elements are fixed to the elastic plate. A rear part of each pressure generation element is fixed to a surface of a fixation plate, which is fixed to a head case. The pressure generation element vibrates in the direction of the length of the pressure generation element to cause a pressure change inside the pressure generation chamber. Due to the pressure change, liquid retained in the pressure generation chamber is discharged in the form of a liquid drop from a nozzle opening (i.e., nozzle hole or nozzle orifice), which is in communication with the pressure generation chamber. An example of the structure explained above is disclosed in, for example, Japanese Patent No. 3879297.

There is a demand for reducing the size of a liquid ejecting head without sacrificing discharging performance. A structure in which a fixation plate is provided for each nozzle line for fixation to a head case has many disadvantages in reducing the size of a liquid ejecting head. In addition, wiring, etc., is more complex.

SUMMARY

An advantage of some aspects of the invention is to provide a liquid ejecting head that features a reduced size without sacrificing reliability and to provide a liquid ejecting apparatus that includes such a liquid ejecting head.

In order to address the above-identified problems without any limitation thereto, a liquid ejecting head according to an aspect of the invention includes: a plurality of pressure generation elements each of which applies a pressure change to liquid retained in a corresponding pressure generation chamber that is in communication with a corresponding nozzle opening so as to discharge the liquid from the nozzle opening; a fixation plate to which a rear part of each of the plurality of pressure generation elements is fixed, the rear part being opposite to a front part, the front part being closer to the corresponding pressure generation chamber; a plurality of nozzle lines each of which includes a plurality of nozzle openings arrayed in a line, the plurality of nozzle lines including at least two nozzle lines provided in parallel to and next to each other; and a flexible substrate through which an electric signal sent from the outside is supplied to the pressure generation chambers, wherein pressure generation elements provided for respective pressure generation chambers that are in communication with respective nozzle openings that belong to one of the two nozzle lines and pressure generation elements provided for respective pressure generation chambers that are in communication with respective nozzle openings that belong to the other of the two nozzle lines are fixed to the fixation plate, which is a common plate, with the fixation plate being sandwiched between the pressure generation elements for the one nozzle line and the pressure generation elements for the other nozzle line, a wiring portion is formed at one end part of the fixation plate opposite to the other end that is closer to the pressure generation chambers, and the flexible substrate is connected to the wiring portion.

In particular, a liquid ejecting head according to an aspect of the invention has the following features: pressure generation elements provided for respective pressure generation chambers that are in communication with respective nozzle openings that belong to one of two nozzle lines provided in parallel to and next to each other and pressure generation elements provided for respective pressure generation chambers that are in communication with respective nozzle openings that belong to the other of the two nozzle lines are fixed to a common fixation plate, with the fixation plate being sandwiched between the pressure generation elements for the one nozzle line and the pressure generation elements for the other nozzle line; a wiring portion is formed at one end part of the fixation plate opposite to the other end that is closer to the pressure generation chambers; and a flexible substrate (flexible substrates) through which an electric signal sent from the outside is supplied to the pressure generation chambers is connected to the wiring portion. With such a structure, the pressure generation elements for the respective nozzle lines (i.e., different nozzle lines) can be fixed to the common fixation plate. In comparison with the structure of a related-art recording head according to which pressure generation elements for a single nozzle line are fixed to each fixation plate, it is possible to reduce the number of fixation plates. Therefore, assembly steps for fixing the pressure generation elements to the fixation plate can be reduced. Thus, it is possible to reduce the risk of occurrence of poor mounting. Moreover, it is possible to make the width of the liquid ejecting head viewed in the direction perpendicular to the nozzle-line direction smaller. As a result, the size of the liquid ejecting head can be reduced.

It is preferable that a liquid ejecting head having the structure described above should further include a connector to which the external signal is supplied. The connector is connected to the wiring portion.

Since the connector to which an external signal is supplied from the outside is connected to the wiring portion, the preferred structure makes it possible to secure electric connection to the wiring portion.

In the structure of a liquid ejecting head according to an aspect of the invention, it is preferable that the thickness of a part of the fixation plate that is opposite a pressure-chamber-side part should be smaller than that of the pressure-chamber-side part. The pressure-chamber-side part is a part that is closer to the pressure generation chambers.

Since the thickness of the part of the fixation plate that is opposite the pressure-chamber-side part is smaller than that of the pressure-chamber-side part, the preferred structure makes it possible to reduce the size of the connector connected to the wiring portion, thereby enhancing the degree of spatial freedom in layout design.

In the structure of a liquid ejecting head according to an aspect of the invention, it is preferable that a group of the pressure generation elements should include driving portions divided from one another with one driving portion being provided for each of the pressure generation chambers and further include a non-driving portion that connects the driving portions with one another; and the fixation plate should have divided regions with a regular width that is the same as the width of the driving part in the direction of the nozzle line.

As described above, in a preferred structure, a group of the pressure generation elements includes driving portions divided from one another with one driving portion being provided for each of the pressure generation chambers and further includes a non-driving portion that connects the driving portions with one another. The fixation plate has divided regions with a regular width that is the same as the width of the driving part in the direction of the nozzle line. The preferred structure makes it possible to cut the fixation plate, the pressure generation elements for the one nozzle line, and the pressure generation elements for the other nozzle line at the same time after the fixing of the pressure generation elements for the one nozzle line at one side of the fixation plate and the pressure generation elements for the other nozzle line at the other opposite side of the fixation plate with the fixation plate sandwiched therebetween. By this means, the driving portions can be divided from one another with one driving portion being provided for each of the pressure generation chambers. Advantageously, the pressure generation elements can be provided on both surfaces of the fixation plate viewed in the direction perpendicular to the nozzle-line direction.

In the structure of a liquid ejecting head according to an aspect of the invention, it is preferable that front ends of the pressure generation elements, which face toward the respective pressure generation chambers, and a front end of the fixation plate, which is also an end closer to the pressure generation chambers, should be formed on the same plane.

As described above, in a preferred structure, the front ends of the pressure generation elements facing toward the respective pressure generation chambers and the pressure-chamber-side end, that is, the front end, of the fixation plate are formed on the same plane. The preferred structure makes it possible to bond the front ends of the pressure generation elements and the front end of the fixation plate at the same time with the application of an adhesive thereto and ensure accurate positional alignment in the concurrent bonding.

In the structure of a liquid ejecting head according to an aspect of the invention, it is preferable that the nozzle openings belonging to the one of the two nozzle lines provided at respective sides of the fixation plate and the nozzle openings belonging to the other thereof should be shifted from each other by one half pitch in the direction of the nozzle line.

As described above, in a preferred nozzle array, the nozzle openings belonging to the one of the two nozzle lines provided at respective sides of the fixation plate and the nozzle openings belonging to the other thereof are shifted from each other by one half pitch in the direction of the nozzle line. The preferred staggered array makes it possible to form a nozzle opening that belongs to the other nozzle line at a position on a virtual extension line that goes in the direction perpendicular to the nozzle-line direction through the center between two nozzle openings that belong to the one nozzle line, thereby arranging the nozzle openings with greater array density viewed in the nozzle-line direction. Thus, a liquid discharging head with the preferred nozzle array has improved liquid-drop discharging capabilities.

A liquid ejecting apparatus according to an aspect of the invention is provided with the liquid ejecting head having the features explained above.

A reliable liquid ejecting apparatus that includes a liquid ejecting head that can reduce the risk of occurrence of poor mounting with a smaller head size can be provided.

BRIEF DESCRIPTION OF THE DRAWINGS

The invention will be described with reference to the accompanying drawings, wherein like numbers reference like elements.

DESCRIPTION OF EXEMPLARY EMBODIMENTS

With reference to the accompanying drawings, the best mode for carrying out the present invention will now be explained in detail. Although various specific features are explained in the following exemplary embodiments of the invention for the purpose of disclosing preferred modes thereof, the scope of the invention is not limited to the specific embodiments described below unless any intention of restriction is explicitly shown. The invention may be modified, altered, changed, adapted, and/or improved without departing from the gist and/or spirit thereof apprehended by a person skilled in the art from explicit and implicit description given herein. In the following description, an ink-jet recording apparatus is taken as an example of a liquid ejecting apparatus according to an aspect of the invention. The ink-jet recording apparatus may be hereinafter simply referred to as a "printer". In addition, an ink-jet recording head is taken as an example of a liquid ejecting head according to an aspect of the invention. The ink-jet recording head may be hereinafter simply referred to as a "recording head".

Figure 8:
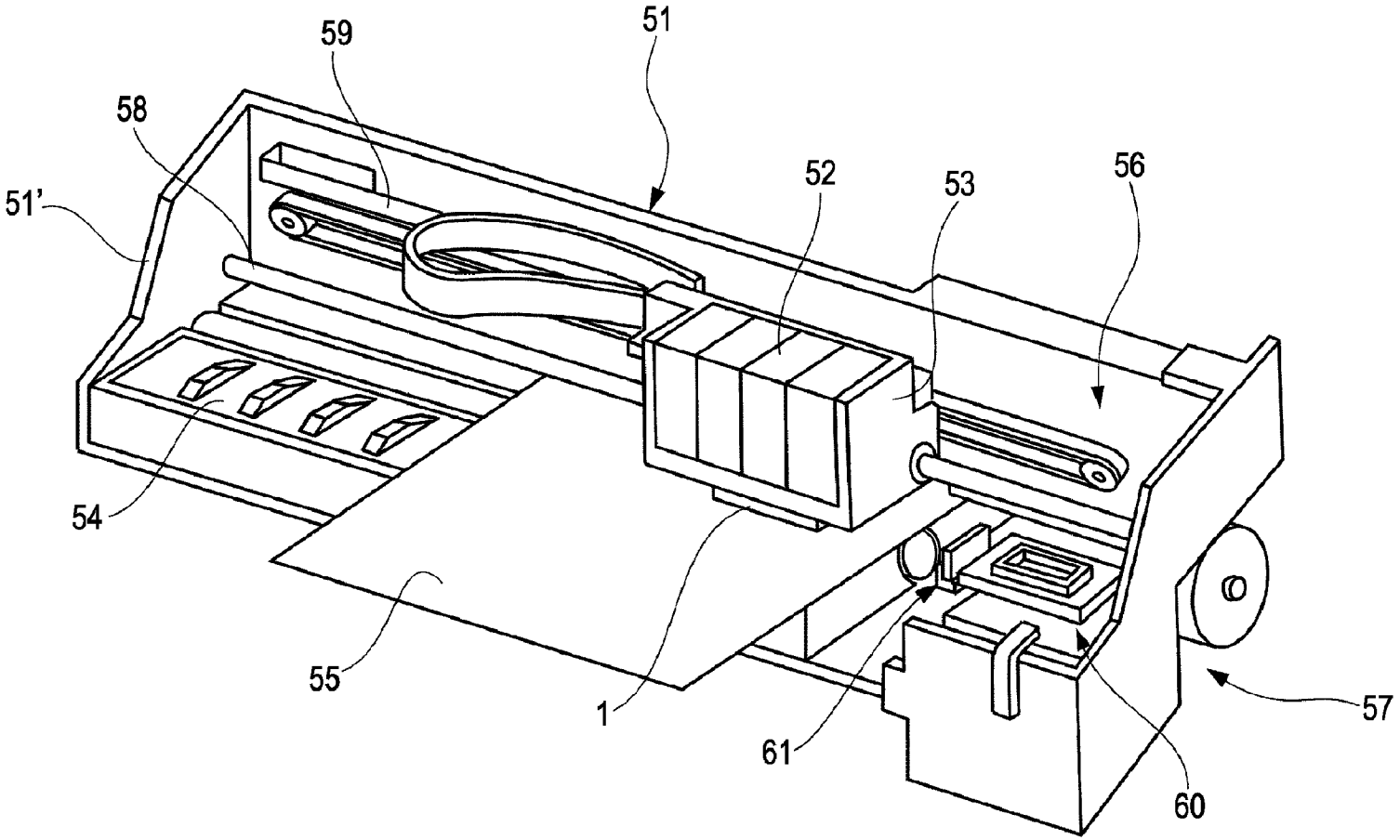
FIG. 8 is a perspective view that schematically illustrates an example of the configuration of a printer according to an exemplary embodiment of the invention.

FIG. 8 is a perspective view that schematically illustrates an example of the configuration of a printer according to an exemplary embodiment of the invention. A printer 51 is provided with a carriage 53, a platen 54, a carriage movement mechanism 56, and a paper transport mechanism 57. A recording head 1 as an example of a liquid ejecting head is mounted on the carriage 53. A plurality of ink cartridges 52 is detachably attached to the carriage 53. The platen 54 is provided below the recording head 1. The carriage movement mechanism 56 reciprocates the carriage 53 (recording head 1) in the direction of the width of recording paper 55, that is, in the main-scan direction. The recording paper is a kind of various recording target media. The paper transport mechanism 57 transports sheets of the recording paper 55 in the sub-scan direction, which is perpendicular to the main-scan direction. A body case 51' of the printer 51 covers these inner components 53, 54, 56, and 57. As an example of a modified configuration, the ink cartridges 52 may be attached not directly to the carriage 53 but to the body case 51' of the printer 51. In such a modified configuration, ink is supplied from the ink cartridges 52 to the recording head 1 through ink-supply tubes.

The carriage 53 is movably supported on a guiding rod 58. The guiding rod 58 extends in the main-scan direction. When driven by the carriage movement mechanism 56, the carriage 53 travels in the main-scan direction along the guiding rod 58. A linear encoder 59 detects the position of the carriage 53 in the main-scan direction. A detection signal is transmitted as an encoder pulse to a controlling unit of a printer controller. The controlling unit is not illustrated in the drawing. The controlling unit can control the recording operation (i.e., ejecting operation) and other various operations of the recording head 1 while recognizing the scan position of the carriage 53 (recording head 1) on the basis of the encoder pulse received from the linear encoder 59.

A home position is set at an end area that is outside a recording area but inside the traveling range of the carriage 53. The home position is the base point of scanning operation. The home position is located at the right side of FIG. 8. In the configuration of the printer 51 according to the present embodiment of the invention, a capping member 60 and a wiping member 61 are provided at the home position. The capping member 60 seals the nozzle surface of the recording head 1, which is a nozzle plate 10 (refer to FIG. 1). The wiping member 61 cleans the nozzle surface of the recording head 1. In outward movement (i.e., outbound movement), the carriage 53 (recording head 1) travels from the home position toward the opposite end. In homeward movement, the carriage 53 travels back to the home position from the opposite end. The printer 51 can record characters, images, and the like on a sheet of the recording paper 55 both during the outward movement and the homeward movement bi-directionally, that is, a so-called two-way recording.

Figure 1:
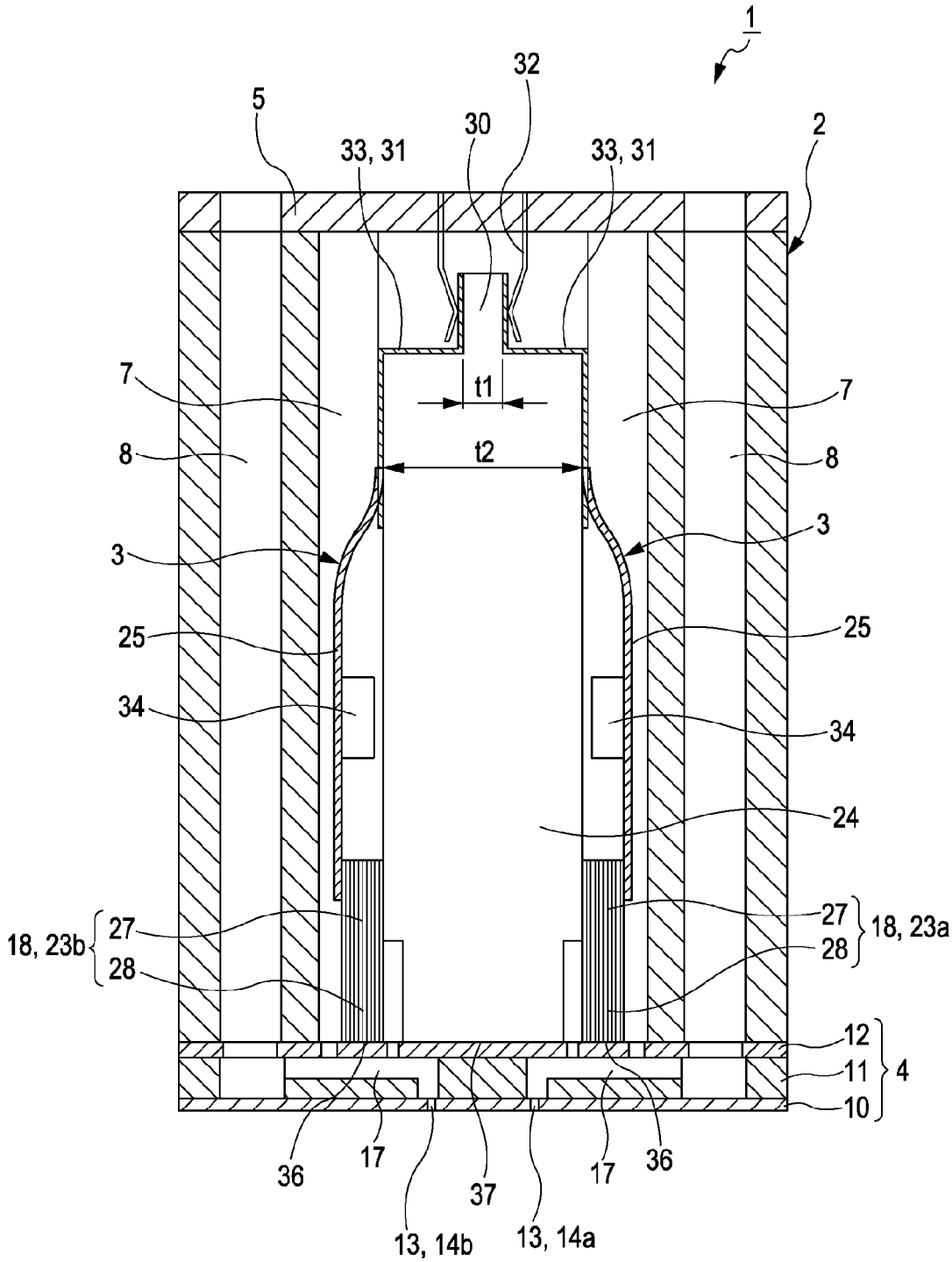
FIG. 1 is a sectional view that schematically illustrates an example of the essential components of a recording head according to an exemplary embodiment of the invention.

FIG. 1 is a sectional view that schematically illustrates an example of the essential components of a recording head according to an exemplary embodiment of the invention. The recording head 1 includes a head case 2, a vibrator unit 3, a fluid channel unit 4, and a connection substrate 5. The vibrator unit 3 is encased in the head case 2. The fluid channel unit 4 is fixed to one surface of the head case 2. The connection substrate 5 is fixed to the other surface of the head case 2 opposite the fluid-channel-side (4) surface. Ink passages through which ink flows from the ink cartridges to nozzle holes (i.e., openings) 13 of the fluid channel unit 4 are formed inside the recording head 1. The ink cartridge is a kind of various liquid supply sources. The ink passage is a kind of various liquid flow channels.

A housing cavity 7 is formed inside the head case 2. The housing cavity 7 is an inner space in which the vibrator unit 3 is accommodated. In addition, ink-induction case flow passages 8 are formed inside the head case 2. Ink that is contained in the ink cartridges enters and flows through the ink-induction case flow passages 8. The vibrator unit 3 is fixed to the inner wall of the housing cavity 7 with the use of an adhesive or by other means. The surface of the head case 2 is fixed to an ink-supply member, which is not illustrated in the drawing. Since the case-side flow passage 8 is in communication with an ink-cartridge-side flow passage, the ink that is contained in the ink cartridge flows in through the ink-induction communication passage. The fluid channel unit 4 is fixed to the opposite surface of the head case 2 with the use of an adhesive or by other means.

Figure 2:
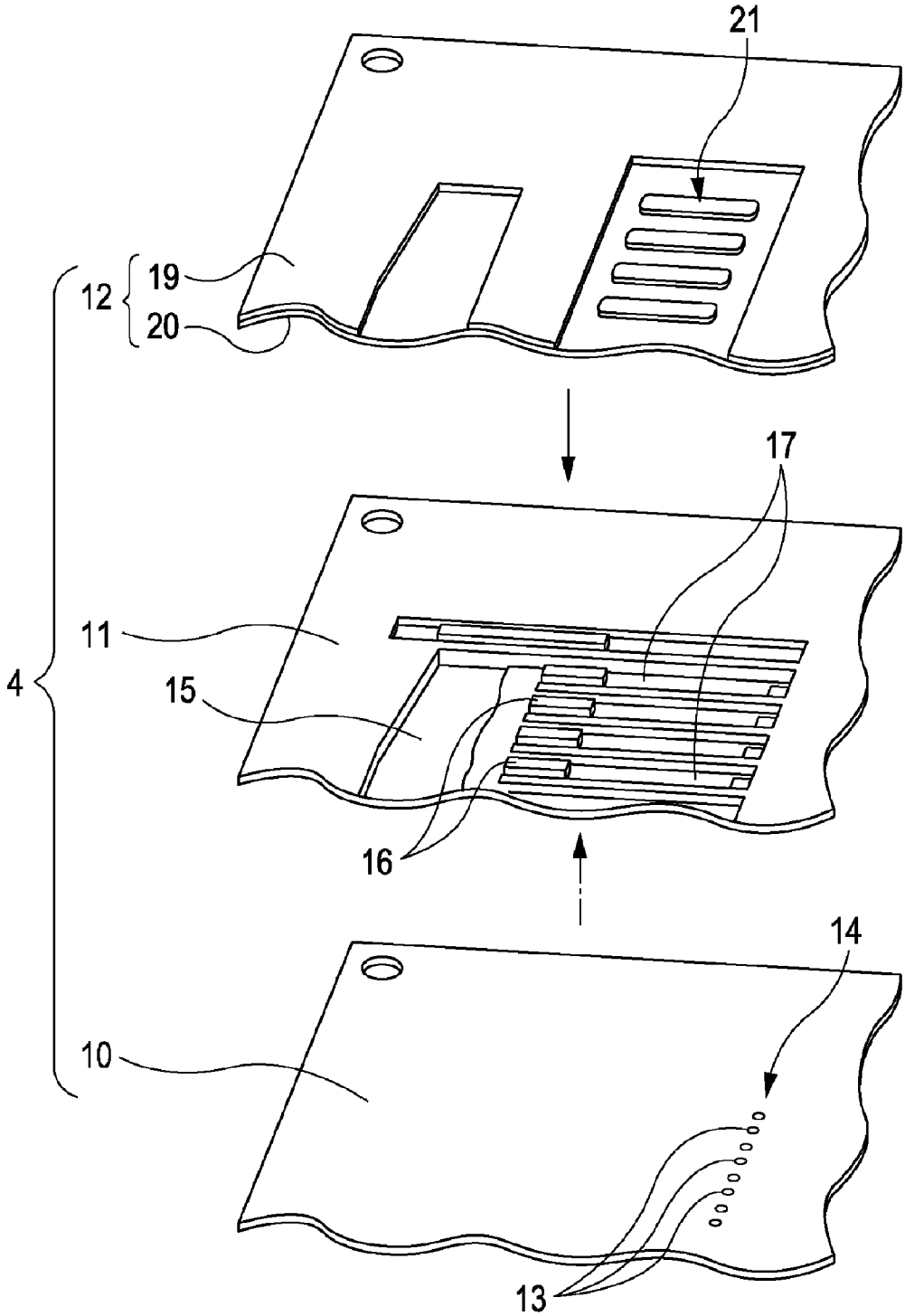
FIG. 2 is an exploded perspective view that schematically illustrates an example of the structure of a fluid channel unit according to an exemplary embodiment of the invention.

Next, the structure of the fluid channel unit 4 is explained below. FIG. 2 is an exploded perspective view that schematically illustrates an example of the structure of a fluid channel unit according to an exemplary embodiment of the invention. As illustrated in FIG. 2, the fluid channel unit 4 is a layered unit that is made up of the aforementioned nozzle plate 10, a fluid channel formation substrate 11, and a vibration plate 12. The fluid channel unit 4 is fixed to the front-end surface of the head case 2 with the use of an adhesive or by other means.

The nozzle plate 10, which is provided as the bottom layer of the fluid channel unit 4, is a thin plate that is made of a metal. The plurality of nozzle openings 13 is arrayed in lines with a pitch corresponding to dot formation density. For example, the pitch is set at 180 dpi. The nozzle plate 10 according to the present embodiment of the invention is made of a stainless steel plate. The plural lines of the nozzle openings 13 (i.e., nozzle lines 14) are provided in the scanning direction of the recording head 1. Each nozzle line is made up of, for example, one hundred eighty nozzle openings 13.

The fluid channel formation substrate 11 is a plate member that is sandwiched between the nozzle plate 10 and the vibration plate 12. A cavity that is made up of a common ink chamber 15, a plurality of ink-supply ports 16, and a plurality of pressure compartments 17 is formed inside the fluid channel formation substrate 11. The cavity functions as ink passages through which ink flows. A plurality of partition walls demarcates these passage compartments. One passage compartment is provided for each of the plurality of nozzle openings 13. These passage compartments are arrayed along the direction of the line of the plurality of nozzles. The nozzle-line direction is hereinafter denoted as L, as shown by an arrow in FIG. 3. The pressure compartment 17 is an example of a pressure generation chamber according to an aspect of the invention. The fluid channel formation substrate 11 is formed by, for example, etching a silicon wafer. The pressure compartment 17 is a space that is elongated in a direction perpendicular to the nozzle-line direction L. That is, the pressure compartment 17 is elongated in the sub-scan direction of the recording head 1. A piezoelectric element 18, which will be explained later, is provided for each of the plurality of pressure compartments 17. Each of the plurality of pressure compartments 17 is provided at a position corresponding to the position of the piezoelectric element 18. The piezoelectric elements 18 are arrayed in the direction indicated by the arrow L. Though it is explained above that silicon is used as the material of the fluid channel formation substrate 11, the fluid channel formation substrate 11 may be formed by, for example, press-working a substrate made of metal such as stainless steel, nickel, or the like.

The vibration plate 12 is a plate member that is provided between the fluid channel formation substrate 11 and the head case 2. The vibration plate 12 is formed as a complex plate having a dual-layer structure. Specifically, the vibration plate 12 is made up of a supporting plate 19 that is made of metal such as stainless steel or the like and an elastic film 20 laminated thereon. An island portion 21 is formed at a partial region of the vibration plate 12 that is opposite the pressure compartment 17 by etching away, or removing by other method, a part of the supporting plate 19 in the shape of a ring. The front-end surface of a free end of the piezoelectric vibrator (i.e., vibration element) 18 is connected to the island portion 21. The part functions as a diaphragm. Since the vibration plate 12 has such a structure, the elastic film 20 around the island portion 21 deforms elastically in accordance with the operation of the piezoelectric vibrator 18.

Figure 3:
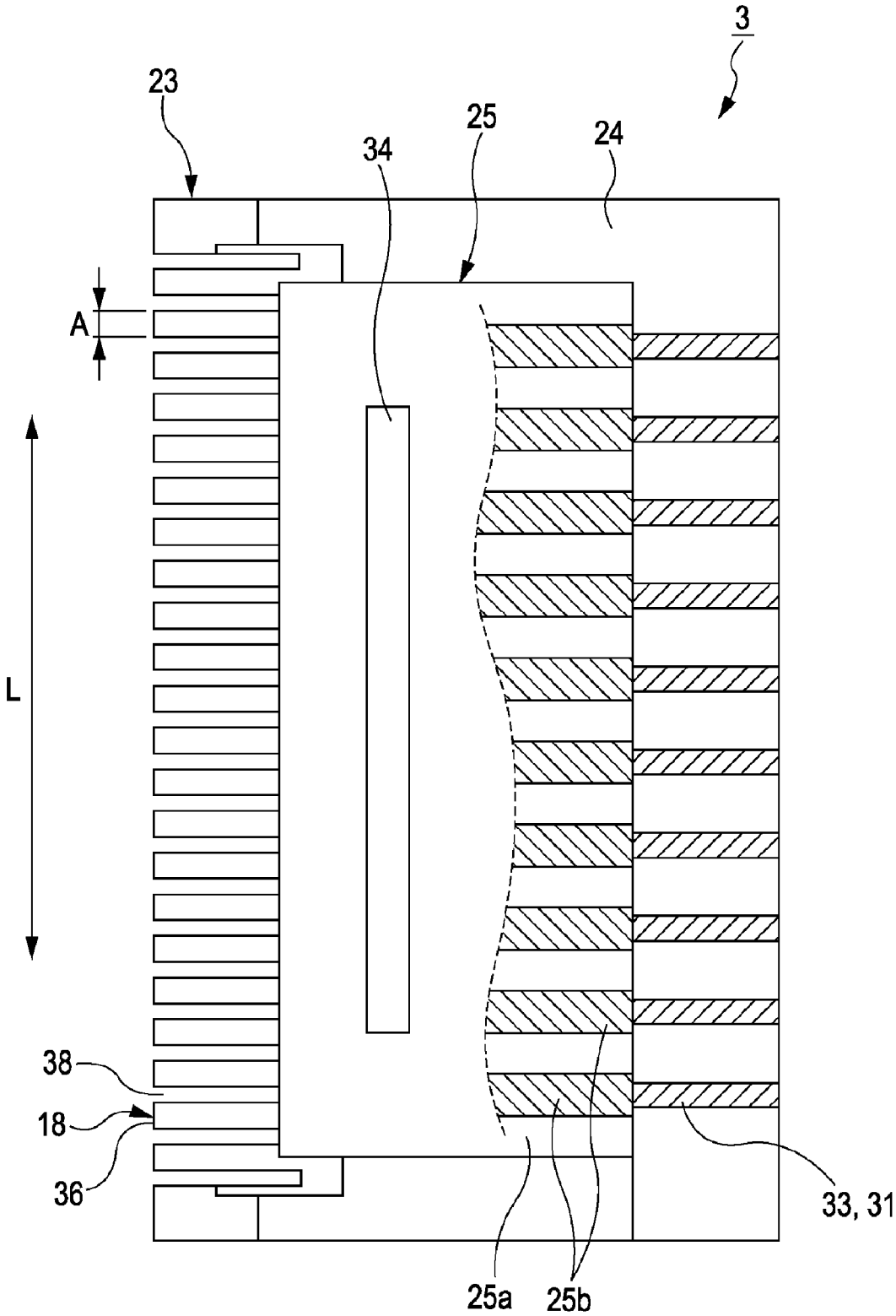
FIG. 3 is a side view that schematically illustrates an example of the structure of a vibrator unit according to an exemplary embodiment of the invention.
Figure 4:
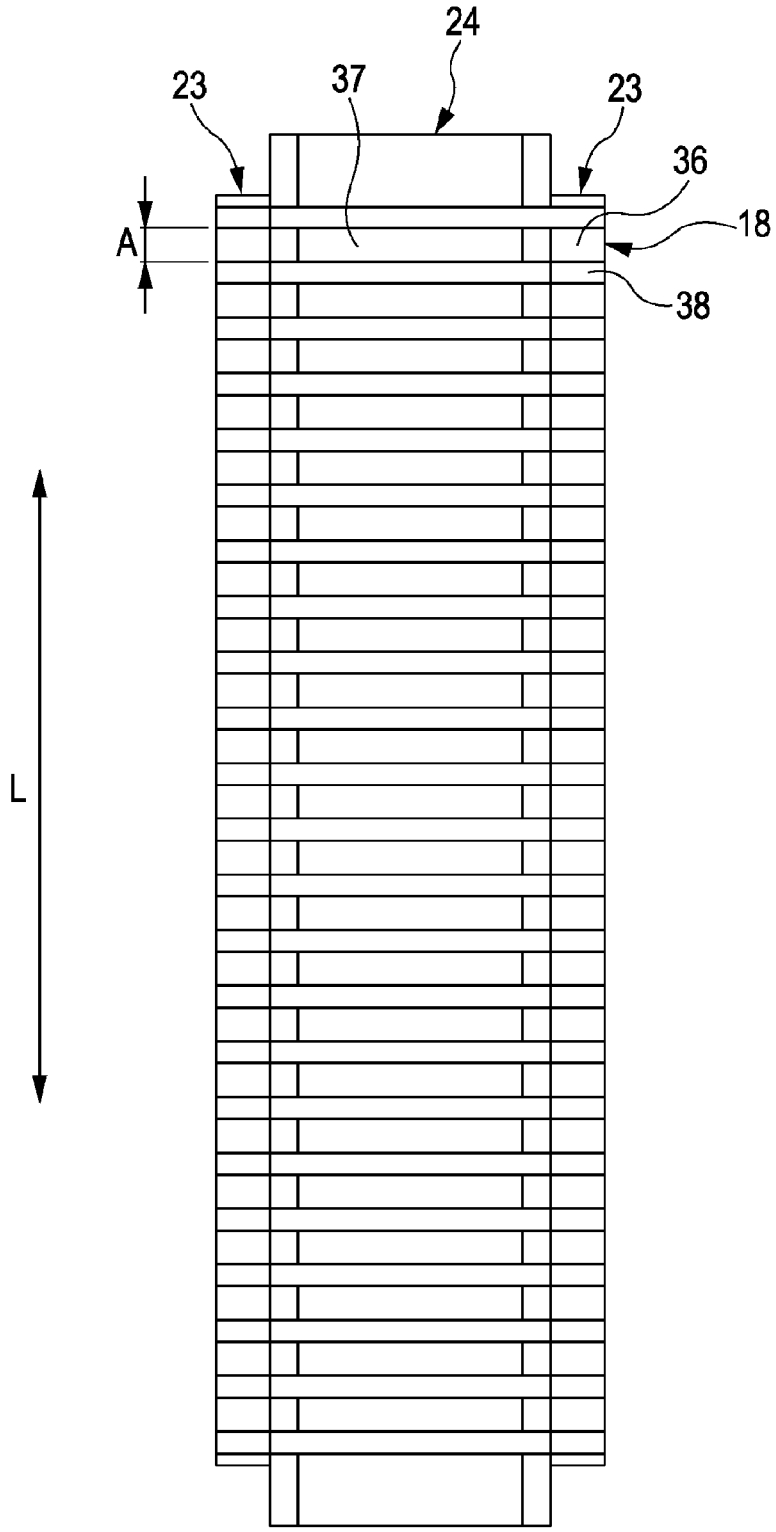
FIG. 4 is a front view that schematically illustrates an example of the structure of the vibrator unit according to an exemplary embodiment of the invention.

Next, the vibrator unit 3 is explained below. FIG. 3 is a side view that schematically illustrates an example of the structure of a vibrator unit according to an exemplary embodiment of the invention. FIG. 4 is a front view that schematically illustrates an example of the structure of the vibrator unit according to an exemplary embodiment of the invention. The vibrator unit 3 includes a cluster of piezoelectric elements (i.e., piezoelectric-element group) 23, an element fixation plate 24, and a COF (Chip On Film) 25. The cluster of piezoelectric elements 23 is shaped like comb teeth. The base-end portion of the cluster of piezoelectric elements 23 is fixed to the element fixation plate 24. The COF 25 is provided for supplying a driving signal to the cluster of piezoelectric elements 23. The piezoelectric element is an example of a pressure generation element according to an aspect of the invention. The element fixation plate 24 is an example of a fixation plate according to an aspect of the invention. The COF 25 is an example of a flexible substrate according to an aspect of the invention.

The cluster of piezoelectric elements 23 includes the plurality of piezoelectric elements 18 arrayed along the nozzle-line direction L. These piezoelectric elements 18 are made up of a plurality of driving elements and a pair of dummy elements. The dummy elements are provided at the respective ends of the line. The driving elements are arrayed between the two dummy elements. The driving elements are separated from one another through a cutting process. Accordingly, the driving elements are arrayed like comb teeth with a very small width of, for example, approximately 50 to 100 μm for each. For example, the number of the driving elements after the cutting process is one hundred and eighty. The width of the dummy element is substantially larger than that of the driving element. The dummy elements have a function of protecting the driving elements against shock or the like. In addition to the protecting function, the dummy elements have a function of determining the position of the vibrator unit 3 at a predetermined position, that is, a guiding function.

The cluster of piezoelectric elements 23 has a non-driving part 27 and driving parts 28. The non-driving part 27 of the cluster of piezoelectric elements 23, which is a fixation-end part, is fixed to the element fixation plate 24. The driving parts 28 of the cluster of piezoelectric elements 23 protrude outward, that is, toward the pressure compartment 17, viewed from an end surface of the element fixation plate 24. The driving part 28 is a free-end part of the cluster of piezoelectric elements 23. In other words, the cluster of piezoelectric elements 23 is supported on the element fixation plate 24 in the form of a so-called a cantilever. The driving part 28 of the cluster of piezoelectric elements 23 is a so-called longitudinal-vibration-mode piezoelectric vibrator, which operates in a displacement direction orthogonal to the direction of an electric field. The driving part 28 of the cluster of piezoelectric elements 23 is made up of piezoelectric substances and inner electrodes that are laminated alternately. When a voltage is applied to cause a potential difference between opposite electrodes, it expands or contracts in the element length direction. These piezoelectric elements 18 are separated from one another with a cut pitch that is the same as the pitch of the pressure compartments 17 formed inside the fluid channel unit 4. One piezoelectric element 18 is provided for each of the plurality of pressure compartments 17 (refer to FIG. 2).

The element fixation plate 24 that supports the cluster of piezoelectric elements 23 is a plate member that is made of metal and has rigidity that is great enough to absorb a reaction force from the cluster of piezoelectric elements 23. In the present embodiment of the invention, stainless steel is used as the material of the element fixation plate 24. As illustrated in FIG. 1, two clusters of piezoelectric elements 23 are fixed to the element fixation plate 24, with the element fixation plate 24 being sandwiched between one of the two clusters of piezoelectric elements 23 and the other viewed in the direction perpendicular to the nozzle-line direction L. The one cluster of piezoelectric elements 23, which is denoted as 23*a* in FIG. 1, is provided for the plurality of pressure compartments 17 that are in communication with the respective nozzles that are arrayed as one of two nozzle lines 14 provided in parallel to and next to each other. The one of these two nozzle lines 14 is denoted as 14*a* in FIG. 1. The other cluster of piezoelectric elements 23, which is denoted as 23*b* in FIG. 1, is provided for the plurality of pressure compartments 17 that are in communication with the respective nozzles that are arrayed as the other of the two nozzle lines 14. The other nozzle line is denoted as 14*b* in FIG. 1. In other words, the two clusters of piezoelectric elements 23*a* and 23*b* are fixed to the respective surfaces of a single common fixation plate 24 opposite to each other.

The thickness of a rear-end part 30 of the element fixation plate 24, which is an opposite end remotest from the pressure compartment 17, is smaller than that of a pressure-compartment-side part. The pressure-compartment-side part is a part closer to the pressure compartment 17. The thickness of the rear-end part 30 is denoted as t1 in FIG. 1. The thickness of the pressure-compartment-side part is denoted as t2 in FIG. 1. A wiring portion 31, which can be connected to a connector 32 that is attached to a connection substrate 5, is provided on the rear-end part 30. Since the thickness of the rear-end part 30 of the element fixation plate 24 is smaller than that of the pressure-compartment-side part, it is possible to make the width of the connector 32 connected to the wiring portion 31 smaller, thereby enhancing the degree of spatial freedom in layout design. In addition, it is possible to make the width of the recording head 1 viewed in the direction perpendicular to the nozzle-line direction L smaller. As a result, the size of the recording head 1 can be reduced.

The wiring portion 31 according to the present embodiment of the invention is made of a film (sputtered electrode 33) that is formed on a surface of the element fixation plate 24 by sputtering. The electric wiring of the COF 25 is soldered or connected by other means to the sputtered electrode 33 exposed on the surface of the element fixation plate 24. One end of the COF 25 is electrically connected to the sputtered electrode 33. The other end of the COF 25 is electrically connected to the cluster of piezoelectric elements 23. The COF 25 is a signal cable for sending an electric signal to the piezoelectric elements 18 through a conductive portion 25*b* that is formed on a surface of a film 25*a*. A control IC 34 for controlling the driving operation of each piezoelectric element 18 is mounted on a surface of the COF 25.

The connection substrate 5 is a wiring substrate on which electric wiring for supplying various signals to the recording head 1 is formed. The connector 32 for signal-cable connection is fixed to the connection substrate 5. The connector 32 is connected to the sputtered electrode 33 of the wiring portion 31. Through the connection between the connector 32 and the sputtered electrode 33, an external electric signal is supplied to the piezoelectric elements 18. A signal cable through which a signal sent from a controller flows is electrically connected to the connector 32. The signal cable is connected to the connector 32 through a conductive portion provided on the connection substrate 5. The controller, which is not illustrated, is provided in a printer body.

As illustrated in FIG. 1, the front-end faces 36 of the piezoelectric elements 18 and the front-end face 37 of the element fixation plate 24 are formed on the same plane. The front ends 36 of the piezoelectric elements 18 face toward the pressure compartments 17. The front end 37 of the element fixation plate 24 is also the pressure-compartment-side end. As illustrated in FIGS. 3 and 4, a plurality of slits 38 is formed in the element fixation plate 24 with the same pitch as that of the piezoelectric elements 18. The width of each slit-divided part of the element fixation plate 24 is the same as the width of the piezoelectric element 18. The width is denoted as A in FIG. 3. Since the front-end faces 36 of the piezoelectric elements 18 and the front-end face 37 of the element fixation plate 24 are formed on the same plane, it is possible to bond the front-end faces 36 and the front-end face 37 to a counterpart surface at the same time with the application of an adhesive thereto and make positional alignment easy and precise in the concurrent bonding. A method for manufacturing the element fixation plate 24 will be explained in detail later.

Ink is supplied from an ink cartridge through an ink-supply passage into the pressure compartment 17. When a pressure change occurs in the pressure compartment 17 due to the operation of the piezoelectric element 18, ink retained in the pressure compartment 17 is discharged from the nozzle opening 13 in the form of an ink drop. The recording head 1 that has the configuration/structure explained above can record an image or the like as a result of the landing of ink drops onto a recording target medium such as a sheet of printing paper.

Next, a method for machining the element fixation plate 24 and the clusters of piezoelectric elements 23*a* and 23*b* is explained below. As a first step, before cutting the cluster of piezoelectric elements 23 (piezoelectric elements 18) to have the shape of the teeth of a comb, the cluster of piezoelectric elements 23*a* and the cluster of piezoelectric elements 23*b* are fixed to the element fixation plate 24, with the element fixation plate 24 being sandwiched between these two clusters of piezoelectric elements 23*a* and 23*b*. When the clusters of piezoelectric elements 23*a* and 23*b* are fixed to the element fixation plate 24, the front end of the element fixation plate 24 is aligned with the front ends of the clusters of piezoelectric elements 23*a* and 23*b*. Next, after the fixing of the clusters of piezoelectric elements 23*a* and 23*b* to the element fixation plate 24, the clusters of piezoelectric elements 23*a* and 23*b* and the element fixation plate 24 are subjected to concurrent cutting at a regular interval with the same width A. As a result, the plurality of slits 38 is formed in the element fixation plate 24. The element fixation plate 24 is "slit-divided" with a regular width A that is the same as the width of the driving part 28 of the piezoelectric element 18 in the nozzle-line direction L. In the manufacturing method explained above, the paired clusters of piezoelectric elements 23*a* and 23*b* and the element fixation plate 24 are cut at the same time after the fixing of the cluster of piezoelectric elements 23*a* to one surface of the element fixation plate 24 and the cluster of piezoelectric elements 23*b* to the other opposite surface of the element fixation plate 24 with the element fixation plate 24 sandwiched therebetween. This method enables the plurality of piezoelectric elements (pressure generation elements) 18 to be provided on both sides of the element fixation plate 24 viewed in the direction perpendicular to the nozzle-line direction L. In addition, since the front end 37 of the element fixation plate 24 and the front ends 36 of the paired clusters of piezoelectric elements 23*a* and 23*b* are fixed to the vibration plate 12, it is possible to secure good rigidity of the element fixation plate 24.

As explained above, the element fixation plate 24 according to the present embodiment of the invention is a common fixation plate to which the clusters of piezoelectric elements 23*a* and 23*b* for the respective nozzle lines 14*a* and 14*b* can be fixed. In comparison with the structure of a related-art recording head according to which a cluster of piezoelectric elements for a single nozzle line is fixed to each fixation plate, it is possible to reduce the number of fixation plates and save space. Therefore, assembly steps for fixing the clusters of piezoelectric elements 23*a* and 23*b* to the element fixation plate 24 can be reduced. Thus, it is possible to reduce the risk of occurrence of poor mounting. In addition, it is possible to reduce the size of the recording head 1.

Moreover, since the wiring portion 31 is made of the sputtered electrode 33 that is formed on a surface of the element fixation plate 24, it is easy to provide the wiring portion 31. Furthermore, the connector 32 to which an external signal is supplied from the outside is connected to the wiring portion 31. In other words, the connector 32 through which the external signal flows to the wiring portion 31 is connected to the wiring portion 31. Therefore, it is possible to secure electric connection between the wiring portion 31 and the connector 32.

Figure 5:
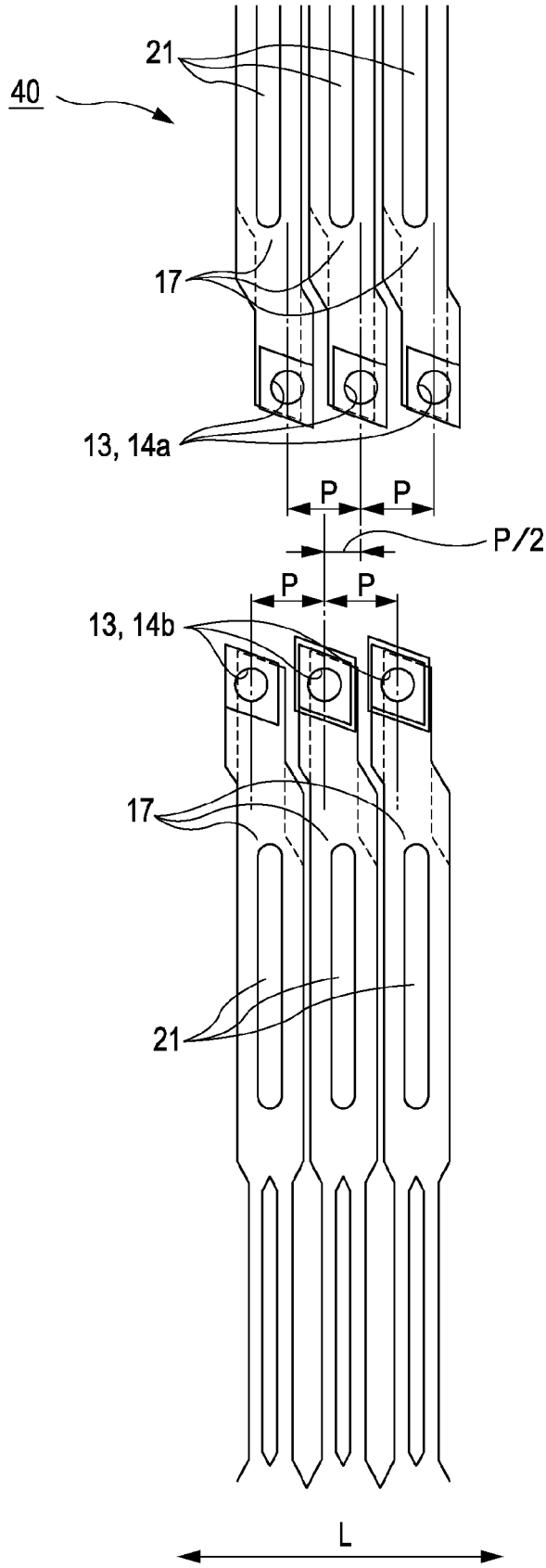
FIG. 5 is a diagram that schematically illustrates an example of the structure of a fluid channel unit according to another embodiment of the invention.

The scope of the invention is not limited to the specific embodiment described above. The invention may be modified, altered, changed, adapted, and/or improved without departing from the gist and/or spirit thereof apprehended by a person skilled in the art from explicit and implicit description given herein. Such a modification and the like are also encompassed within the scope of the appended claims. FIG. 5 is a diagram that schematically illustrates an example of the structure of a fluid channel unit according to another embodiment of the invention. A fluid channel unit 40 according to the present embodiment of the invention is characterized by staggered array of the nozzle openings 13. Specifically, as illustrated in FIG. 5, the nozzle openings 13 of the nozzle line 14*a* corresponding to one 23*a* of paired clusters of piezoelectric elements fixed at respective sides of the element fixation plate 24 and the nozzle openings 13 of the nozzle line 14*b* corresponding to the other 23*b* thereof (that is, 14*a* and 23*a* at one side whereas 14*b* and 23*b* at the other side) are shifted from each other by one half pitch in the nozzle-line direction L. One pitch is denoted as P in the ½ pitch staggered array shown in FIG. 5. The fluid channel unit 40 having the staggered array explained above has the following advantage. The nozzle opening 13 that belongs to the other nozzle line 14*b* can be formed at a position on a virtual extension line that goes in the direction perpendicular to the nozzle-line direction L through the center between two nozzle openings 13 that belong to one nozzle line 14*a*. Therefore, it is possible to array the nozzle openings 13 with greater array density viewed in the nozzle-line direction L. Thus, the recording head 1 according to the present embodiment of the invention offers greater ink-drop discharging performance.

Figure 6:
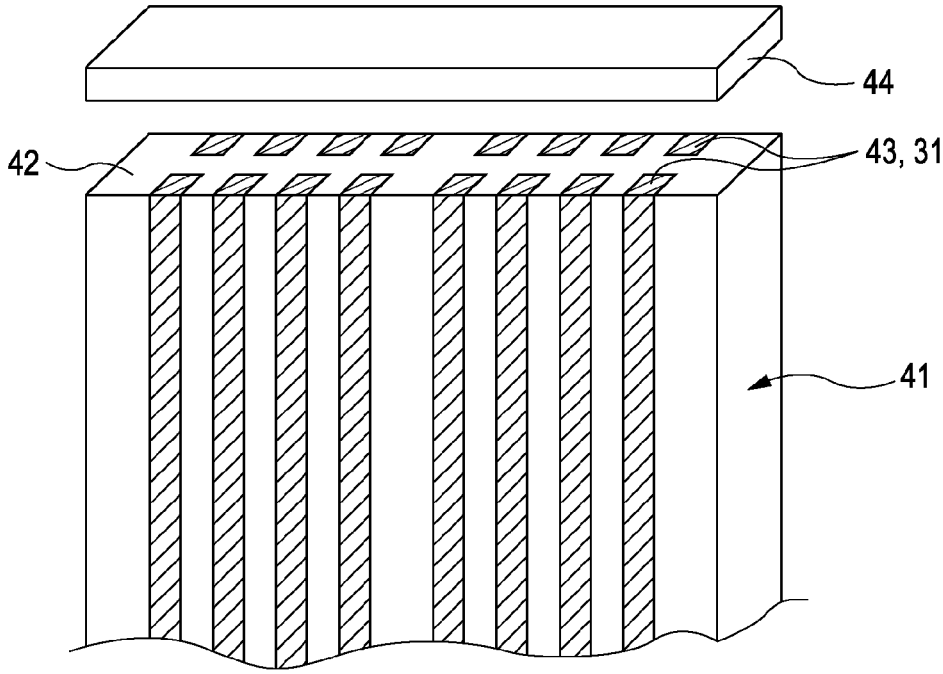
FIG. 6 is an enlarged perspective view that schematically illustrates an example of the structure of an element fixation plate according to still another embodiment of the invention.

FIG. 6 is an enlarged perspective view that schematically illustrates an example of the structure of an element fixation plate according to still another embodiment of the invention. In this embodiment, the height of an element fixation plate 41 from its bottom end face, which is located near the pressure compartments 17, to the opposite top end face 42 is set to reach the connection substrate 5. Electrodes 43 are exposed at the top end face 42. The exposed electrodes 43 constitute the wiring portion 31. A conductive rubber 44 is sandwiched between the electrodes 43 and opposite electrodes provided on the connection substrate 5. The opposite electrodes are not illustrated in the drawing. The connection substrate 5 is electrically connected to the COF 25 through the conductive rubber 44 and the electrodes 43 without using any connector. With the structure of the element fixation plate 41 explained above, it is possible to reduce the size of the recording head 1 without impairing the reliability in connection between the connection substrate 5 and the COF 25.

Figure 7:
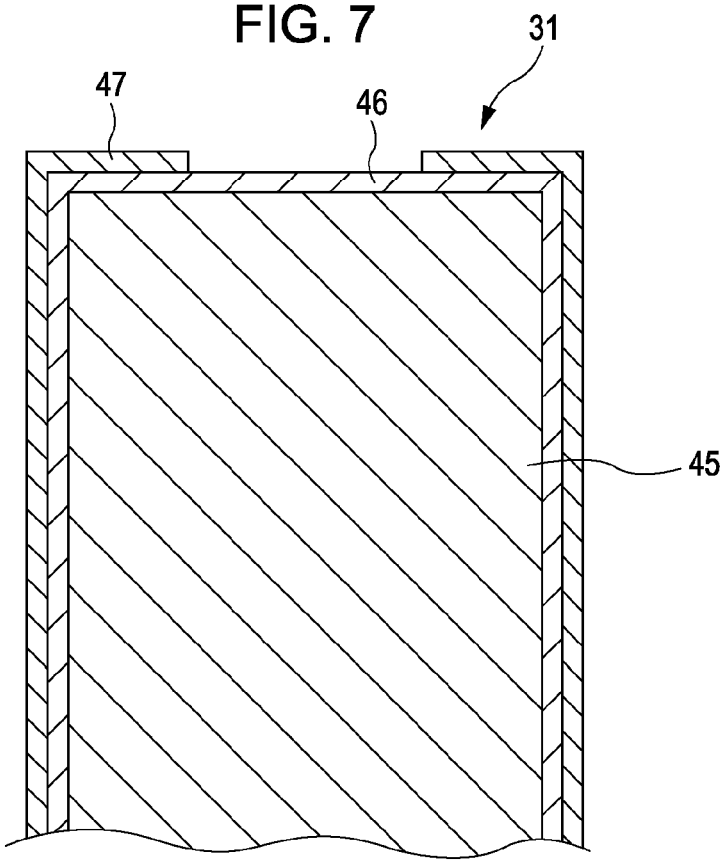
FIG. 7 is an enlarged sectional view that schematically illustrates an example of the structure of an element fixation plate according to still another embodiment of the invention.

FIG. 7 is an enlarged sectional view that schematically illustrates an example of the structure of an element fixation plate according to still another embodiment of the invention. In this embodiment, an element fixation plate 45 is made of a conductive material. The external surface of the element fixation plate 45 is taped with a flexible tape 46. A copper electrode 47 is formed on the flexible tape 46 as the wiring portion 31. Since the wiring portion 31 is formed as explained above, it is possible to easily connect the connection substrate 5 and the COF 25 when the size of the recording head 1 is reduced.

An ink-jet recording head and an ink-jet recording apparatus (printer) that is provided with the ink-jet recording head are taken as an example in the foregoing description of exemplary embodiments of the invention. However, the scope of the invention is not limited thereto. The invention can be applied to various types of a liquid ejecting head including but not limited to: a color material ejection head that is used in the production of a color filter for a liquid crystal display device or the like; an electrode material ejection head that is used for the electrode formation of an organic electroluminescence (EL) display device, a surface/plane emission display device (FED), and the like; and a living organic material ejection head that is used for production of biochips. In addition, the invention can be applied to various types of an ink-jet recording apparatus that is provided with such a liquid ejecting head.

What is claimed is:

1. A liquid ejecting head comprising:

a plurality of pressure generation elements each of which applies a pressure change to liquid retained in a corresponding pressure generation chamber that is in communication with a corresponding nozzle opening so as to discharge the liquid from the nozzle opening;

a fixation plate to which a rear part of each of the plurality of pressure generation elements is fixed, the rear part being opposite to a front part, the front part being closer to the corresponding pressure generation chamber;

a plurality of nozzle lines each of which includes a plurality of nozzle openings arrayed in a line, the plurality of nozzle lines including at least two nozzle lines provided in parallel to and next to each other; and a flexible substrate through which an electric signal sent from the outside is supplied to the pressure generation chambers, wherein pressure generation elements provided for respective pressure generation chambers that are in communication with respective nozzle openings that belong to one of the two nozzle lines and pressure generation elements provided for respective pressure generation chambers that are in communication with respective nozzle openings that belong to the other of the two nozzle lines are fixed to the fixation plate, which is a common plate, with the fixation plate being sandwiched between the pressure generation elements for the one nozzle line and the pressure generation elements for the other nozzle line, a wiring portion is formed at one end part of the fixation plate opposite to the other end that is closer to the pressure generation chambers, and the flexible substrate is connected to the wiring portion.

2. The liquid ejecting head according to claim 1, further comprising a connector to which the external signal is supplied, the connector being connected to the wiring portion.

3. The liquid ejecting head according to claim 1, wherein the thickness of a part of the fixation plate that is opposite a pressure-chamber-side part is smaller than that of the pressure-chamber-side part, the pressure-chamber-side part being a part that is closer to the pressure generation chambers.

4. The liquid ejecting head according to claim 1, wherein a group of the pressure generation elements includes driving portions divided from one another with one driving portion being provided for each of the pressure generation chambers and further includes a non-driving portion that connects the driving portions with one another; and the fixation plate has divided regions with a regular width that is the same as the width of the driving part in the direction of the nozzle line.

5. The liquid ejecting head according to claim 1, wherein front ends of the pressure generation elements, which face toward the respective pressure generation chambers, and a front end of the fixation plate, which is also an end closer to the pressure generation chambers, are formed on the same plane.

6. The liquid ejecting head according to claim 1, wherein the nozzle openings belonging to the one of the two nozzle lines provided at respective sides of the fixation plate and the nozzle openings belonging to the other thereof are shifted from each other by one half pitch in the direction of the nozzle line.

7. A liquid ejecting apparatus that is provided with the liquid ejecting head according to claim 1.

* * * * *